US006312179B1

(12) United States Patent
Gueret

(10) Patent No.: US 6,312,179 B1
(45) Date of Patent: Nov. 6, 2001

(54) DEVICE FOR APPLYING A PASTY PRODUCT, PARTICULARLY A COSMETIC PRODUCT SUCH AS LIPSTICK

(75) Inventor: Jean-Louis H. Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 08/354,803

(22) Filed: Dec. 12, 1994

(30) Foreign Application Priority Data

Dec. 14, 1993 (FR) ..... 93 14969

(51) Int. Cl.[7] ..... B43K 21/08
(52) U.S. Cl. ..... 401/78; 401/80
(58) Field of Search ..... 401/78, 80, 75

(56) References Cited

U.S. PATENT DOCUMENTS

| | | |
|---|---|---|
| 2,777,572 | 1/1957 | Cusack . |
| 3,308,939 | 3/1967 | Sakalys . |
| 3,515,493 | 6/1970 | Gruska . |
| 5,096,318 | 3/1992 | Susini et al. . |
| 5,234,275 | 8/1993 | Gueret . |
| 5,324,126 | 6/1994 | Holloway et al. . |

FOREIGN PATENT DOCUMENTS

| | | |
|---|---|---|
| 9115965 | 5/1992 | (DE) . |
| 0 428 794 | 5/1991 | (EP) . |
| 0 439 381 | 7/1991 | (EP) . |
| 0 491 579 | 6/1992 | (EP) . |
| 0 620 988 | 10/1994 | (EP) . |
| 92615 | 12/1968 | (FR) . |
| 1427931 * | 3/1976 | (GB) ..... 401/75 |
| 49-78178 | 10/1947 | (JP) . |
| 50-2913 | 5/1948 | (JP) . |
| 55-66611 | 10/1953 | (JP) . |
| 56-145408 | 3/1955 | (JP) . |
| 57-194414 | 6/1956 | (JP) . |
| 60-2913 | 1/1985 | (JP) . |
| 62-501128 | 5/1987 | (JP) . |
| 64-62103 | 3/1989 | (JP) . |
| 4-072333 | 3/1992 | (JP) . |
| 4-72333 | 3/1992 | (JP) . |
| 4-44818 | 4/1992 | (JP) . |
| 4-80413 | 7/1992 | (JP) . |
| 4-341209 | 11/1992 | (JP) . |
| 86/03658 | 7/1986 | (WO) . |

* cited by examiner

*Primary Examiner*—David J. Walczak
(74) *Attorney, Agent, or Firm*—Young & Thompson

(57) ABSTRACT

The device comprises: a tubular element (1) with a slideway in which there is mounted so that it can slide a cup (3) intended to receive a stick (B) of product and including at least one stub (4) engaged in a slideway (2); a cylindrical casing (11) in the wall of which is provided at least one helical slot (13), this casing being fitted tightly onto the tubular element, the stub (4) being engaged in a slot (13); and an outer sleeve (14) in which the casing (11) is immobilized, while the tubular element (1) can turn relative to the casing (11) and sleeve (14). Flexible rubbing means (F) are provided between the casing (11) and the tubular element (1), and these include at least one tongue (15), flexible in the radial direction, provided on one of the components and designed to interact with an inclined bearing surface (20) provided on the other component. The tongue (15) and the inclined bearing surface (20) are situated, in the axial direction, beyond the lower end of the outer sleeve (14).

33 Claims, 5 Drawing Sheets

DEVICE FOR APPLYING A PASTY PRODUCT, PARTICULARLY A COSMETIC PRODUCT SUCH AS LIPSTICK

The invention relates to a device for applying a pasty product, particularly a cosmetic product such as lipstick, presented in the form of a stick.

The device envisaged by the invention is of the sort of those which comprise:

- a tubular element with a slideway in which is mounted so that it can slide a cup intended to receive the stick of product and including at least one stub engaged in a slideway;
- a cylindrical casing in the wall of which there is provided at least one helical slot, this casing being fitted tightly onto the tubular element and being held on the latter by axial abutment means, the stub of the cup being engaged in a slot of the casing;
- and an outer sleeve, particularly a metal one, in which the casing is immobilized, while the tubular element can turn relative to the said casing and sleeve, flexible bearing means being provided between the two components consisting of the casing and the tubular element, these bearing means including at least one tongue, which is flexible in the radial direction, provided on one of the two components and designed to interact with a bearing surface which is inclined relative to the axis of the tubular element, provided on the other component.

A device of this sort is known especially from FIG. 8 of U.S. Pat. No. 3,515,493. However, the solution proposed by this document poses problems of practical implementation, because the radial space left to the flexible tongue for producing it and deforming it is small between the outer sleeve and the tubular element. This space barely corresponds to the radial depth of the helical slot, which depth is slight.

EP-A-0,491,579 shows, especially in FIG. 5, a device which makes it possible to take up play, essentially in the radial direction, between the various elements of the mechanism and, simultaneously, a smooth operation during the rotation of the tubular element with a slideway relative to the cylindrical casing and to the metal sleeve. However, the solution proposed by this document does not make it possible to obtain satisfactory compensation for the play in the longitudinal direction.

Above all, the object of the invention is to provide a device of the sort previously defined which is relatively simple to produce, especially as regards the molding and demolding operations, and in which the flexible bearing means can act with sufficient freedom to provide good elastic self-centering and an anti-vibration effect. The stick of pasty product is then better protected against shocks.

According to the invention, a device for applying a pasty product, particularly a cosmetic product such as lipstick, presented in the form of a stick, of the sort defined previously, is characterized in that the flexible bearing means consisting of the tongue or tongues and the inclined bearing surface are situated, in the axial direction, beyond the lower end of the outer sleeve.

The bearing surface may be frustoconical.

As a variant, the bearing surface is formed of a surface which is outwardly concave.

Advantageously, the maximum outer diameter of all these flexible bearing means is substantially equal to the outer diameter of the said sleeve.

Under these conditions, sufficient radial space is available to accommodate the flexible bearing means, whose effectiveness is thereby improved, and whose manufacture is substantially facilitated, especially as regards the molding and demolding operations.

Preferably, at least two diametrically opposed elastic tongues are designed to interact with the inclined-bearing surface.

According to a first possibility, the inclined bearing surface is a frustoconical surface or equivalent provided on the base of the tubular element, while the tongue or tongues are provided on the cylindrical casing. The frustoconical surface may point such that its large diameter is situated at the bottom, the tongue or tongues being provided at the bottom of the casing and being radially offset outwards relative to the casing so that an annular shoulder is formed at the root of the tongues, on the outer surface of the casing. The said shoulder advantageously constitutes an axial abutment for the outer sleeve.

As a variant, the frustoconical surface provided on the base points so as to have its large diameter at the top and this surface is concave, while the tongue or tongues provided at the bottom of the casing are urged radially inwards by the said frustoconical surface.

The internal face of the tongues provided at the bottom of the cylindrical casing is preferably situated substantially on the same cylindrical surface as the bottom of the helical slot.

According to another possibility, the frustoconical surface pointing outwards or inwards is provided at the bottom of the casing equipped with the helical slot, while the tongue or tongues are provided on the base of the tubular element and point upwards so as to interact outwards or inwards with the abovementioned frustoconical surface.

The inclined bearing surface may constitute part of a groove or of a rib with a transverse section in the form of a V or of an arc of a curve, with which a part of conjugate shape of the or of each tongue interacts.

The tongues may have a radial thickness which varies in the axial direction, this dimension diminishing in the direction of the free end of the tongue.

The tongues may have a curved shape, both as regards their contour and their profile lengthways in a plane passing through the axis of the device.

The tongues may include, at their ends, means making it possible to improve sliding and to diminish friction, particularly beads or recesses.

Each of the tongues may extend from a root to a free end, the root of the tongues having a same axial position.

The bottom of each slit bounding a fin preferably has a rounded shape.

Self-centering takes place in the longitudinal direction and in the radial direction.

The substance used for the cylindrical casing including the helical slot or slots is chosen from among the group of polystyrenes, polyolefins, polyacetals, derivatives of polytetrafluoroethylene and polyesters.

The molded substance of the tubular element is preferably chosen from among the group of polyolefins, polystyrenes, cellulose acetates and propionates, vinyl polymers, polyacetals and derivatives of polytetrafluoroethylene.

The substance used for molding the tubular element on the one hand, and/or the cylindrical casing equipped with the helical slot, on the other hand, preferably includes from 0.2 to 20% of a sliding agent such as boron nitride, molybdenum disulphide, graphite or silicones.

According to another characteristic of the invention which may be used independently or in combination with the characteristics set out hereinabove, a device for applying a pasty product, particularly a cosmetic product such as lipstick, presented in the form of a stick, of the sort defined previously, is characterized in that the tubular element with a slideway includes at least one relatively elastic strip, bounded by two longitudinal slits which are substantially parallel to the axis of the tubular element, this strip being attached at its narrow ends to the tubular element, while the cup and/or the strip includes at least one radially-projecting external and/or internal protuberance, designed to bear against the surface of the component with which it interacts, the strip exerting an elastic force on the said cup so as to take up the transverse play and maintain contact between the cup and a part of the internal surface of the tubular element.

Advantageously, the longitudinal profile of the internal surface of the strip is inwardly convex.

The tubular element with a slideway may include a closed bottom designed to reinforce its rigidity and facilitate its fastening, particularly by bonding, to a base piece.

The base of the tubular element may include, underneath the flexible bearing means, radially projecting annular discs, forming boss beading, designed to fasten the tubular element into a base piece.

The base of the tubular element may include at least one elastic protuberance designed to project radially on its external lateral surface and capable of being deformed elastically inwards, while a base piece intended to cover over the lower part of the tubular element includes conjugate fastening means, particularly a recess provided on the internal surface of the base piece and into which the corresponding elastic protuberance can snap-fasten.

The base of the tubular element may include a central hole or a central sleeve provided in a thick bottom wall designed to fit tightly, with clamping, over a pip projecting from the bottom of the base piece. In this case, the presence of the annular discs is not necessary.

As a variant, the base includes a central hole and star-like radial slits radiating from this hole, and defining deformable sectors, while the base piece includes a pip, advantageously frustoconical and equipped with catches, onto which the internal ends of the sectors of the bottom of the base fasten.

The base piece connected to the base of the tubular element may consist of a decorative base piece or of a weighting-down means which will, itself, be surrounded by a decorative covering.

Advantageously, the base of the tubular element includes axial abutment means on its outer surface, situated radially outwards relative to the rubbing means, these axial abutment means being designed to interact with the lower end of tongues provided at the bottom of the cylindrical casing so as to limit the axial engagement of the tubular element into the said cylindrical casing.

The tongues may consist of two groups having different heights and profiles, the tongues of one group belonging to the bearing means and being intended to bear, via their ends, on the said inclined bearing surface, while the tongues of the second group are situated radially outside the bearing surface so that they can interact solely with the axial abutment means of the base, the tongues of this second group having a greater height than that of the first group. The internal face of the tongues of the second group progressively moves away from the axis of the cylindrical casing from top to bottom, while the external face is substantially parallel to this axis; the tongues of the first group have a different shape with their internal face substantially parallel to the axis and their external face progressively nearing the axis from top to bottom.

The base of the tubular element may include, underneath the flexible bearing means, radially projecting annular discs, forming boss beading, designed to fasten the tubular element into a base piece.

Advantageously, the bottom of the outer base piece is removable and the tubular element can be taken off downwards, when the bottom is removed, to be replaced by a refill, the bottom being put back in place.

According to a refillable device alternative, the bottom of the base piece is mounted so that it can slide in this base piece, but connected in terms of rotation to the said base piece, elastic means being provided between the bottom and the lower part of the tubular element, the bottom being equipped with a cylindrical skirt of which the internal upper edge has a frustoconical shape conjugate to the frustoconical surface of at least one elastic fastening protuberance provided on the tubular element, the whole being such that in the normal position, the upper edge of the bottom exerts a braking action on the protuberance and the tubular element, whilst by driving the bottom in axially the protuberance is made to bend radially inwards with unfastening of the tubular element, which can then be removed from above and replaced by a refill.

Apart from the provisions explained hereinabove, the invention consists in a certain number of other provisions which will be dealt with more fully later with regard to embodiments described with reference to the appended drawings, but which are in no way limiting.

FIG. 1 of these drawings is a vertical axial section through a device according to the invention for applying lipstick in the form of a stick.

FIG. 1*a* represents, on a larger scale, a detail of the flexible bearing means of FIG. 1.

Figure 19:
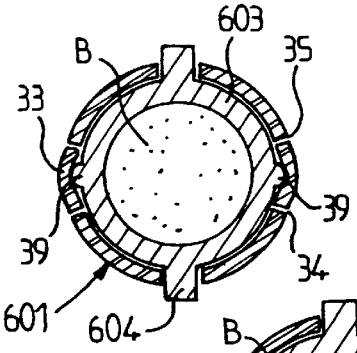
FIG. 19 is a transverse section on the line XIX—XIX of FIG. 18.
Figure 19A:
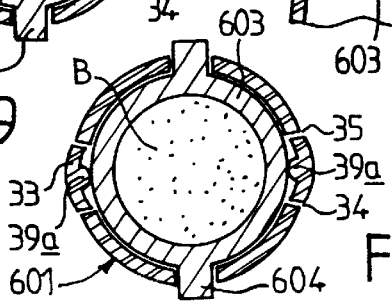

FIG. 19*a* shows, similarly to FIG. 19, a variant embodiment.

Figure 20:
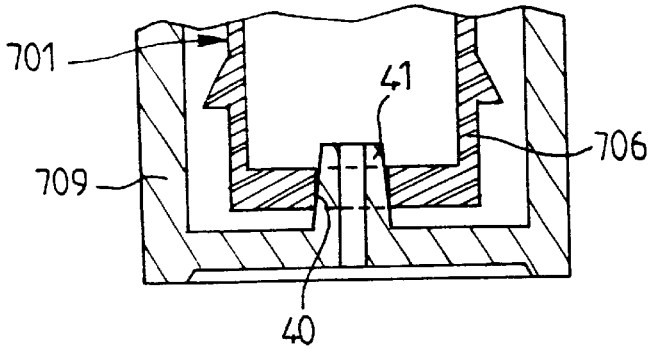

FIG. 20 is a partial vertical section illustrating a variant for fixing the base of the tubular element into the base piece.

Figure 21:
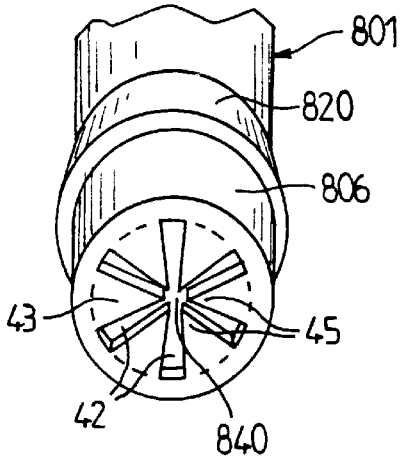

FIG. 21 is a view in perspective of a variant embodiment of the base of the tubular element.

Figure 22:
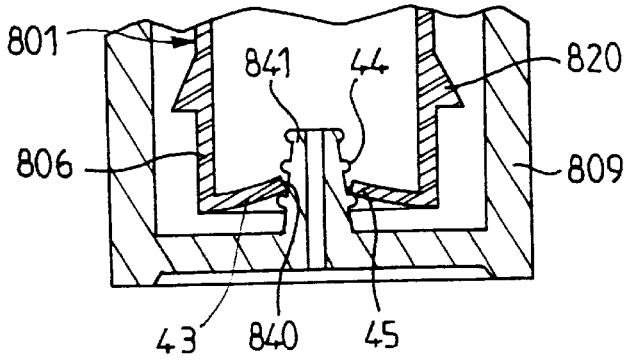

FIG. 22 is a partial vertical section illustrating the fixing of the base of FIG. 21.

Figure 23:
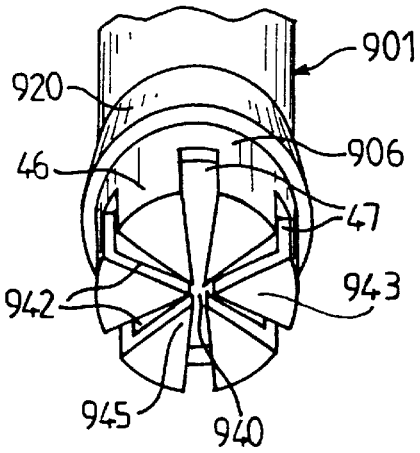

FIG. 23 is a view in perspective of another variant of the base of the tubular element.

Figure 24:
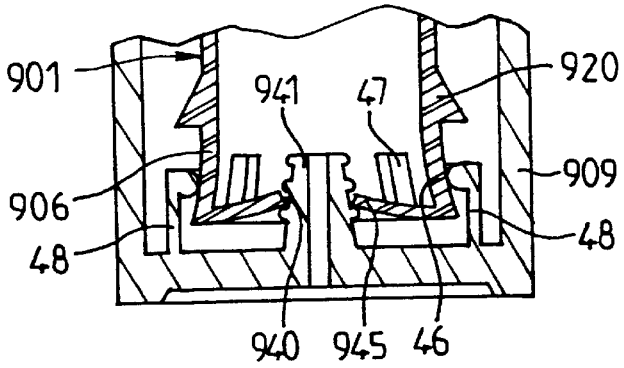

FIG. 24 illustrates in partial vertical section the fixing of the base of FIG. 23.

Figure 1:
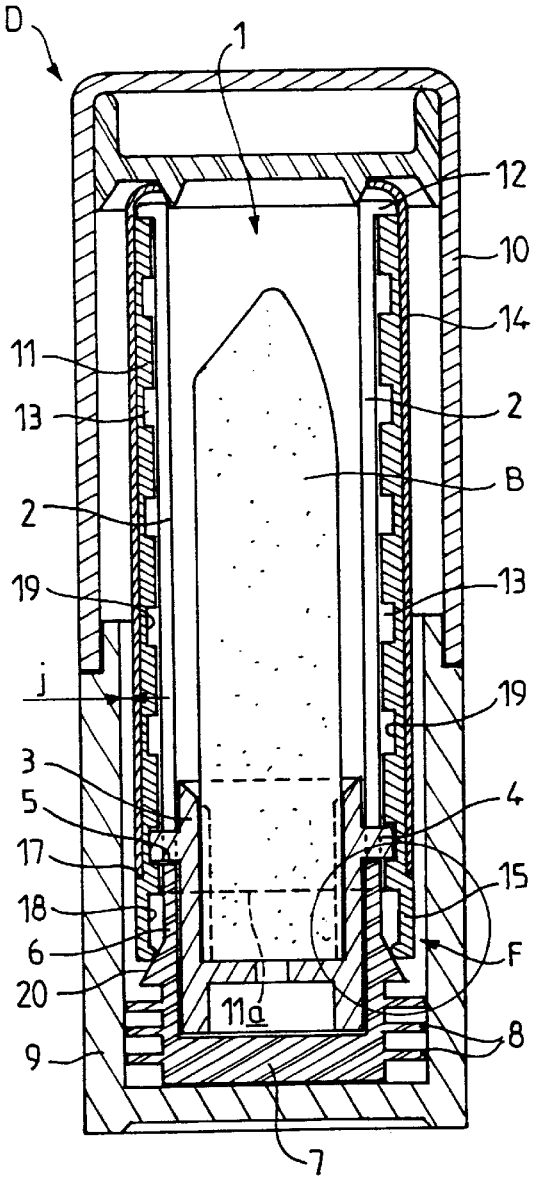
Figure 25:
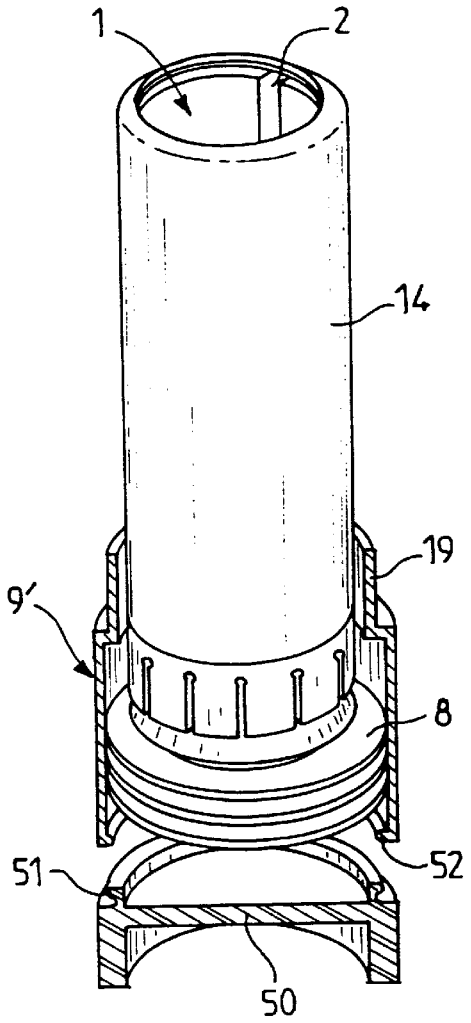

FIG. 25 shows, in perspective, with parts cut away, a variant embodiment of FIG. 1 with removable bottom of the base piece and the possibility of refilling the device with a new tubular element.

Figure 16:
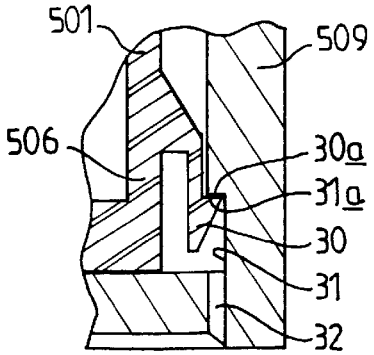
FIG. 16 is a vertical partial section of a variant embodiment illustrating the fastening of the base of the tubular element into a base piece.
Figure 26:
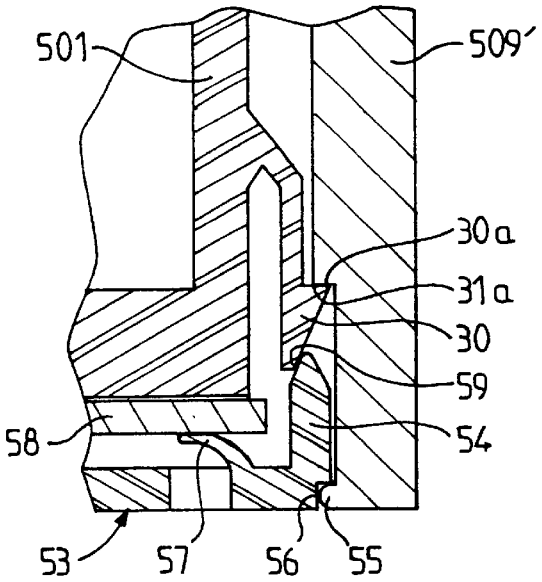

Finally, FIG. 26 shows a variant embodiment of FIG. 16, also allowing the device to be refilled.

Referring to FIG. 1 of the drawings, there can be seen a device D for applying a pasty product, consisting of lipstick presented in the form of a stick B.

The device D comprises a tubular element 1 with a slideway 2 consisting of a longitudinal slit extending from the bottom upwards in the direction of the generatrices of the element 1. For preference, two diametrically opposed slideways 2 are provided.

A cup 3 is mounted so that it can slide inside the tubular element. The stick B of lipstick is received and held clamped in the cup 3. This cup, of cylindrical shape, includes two diametrically opposed stubs 4 projecting radially outwards. The stubs 4 are engaged in the slideways 2 and pass through these slideways, overhanging onto the outer surface of the tubular element 1.

At least one slideway 2 emerges at the top. The slideways 2 stop at the bottom at an end 5 below which the tubular element 1 is extended by a cylindrical base 6 itself closed, at its lower end, by a transverse bottom 7 which gives the base 6 good rigidity. The height of the base 6 is sufficient to accommodate the cup 3 in the bottom position when the stubs 4 are bearing against the ends 5 of the slideways 2.

The base 6 is equipped on its periphery at the bottom with concentric superimposed discs 8, forming boss beading, with sufficient outside diameter to fasten the base 6 correctly into an outer base piece 9, for example of prismatic shape with a square section. The base piece 9 is capped by a removable cap 10 which allows the device to be closed for a storage position. For use and application of lipstick, the cap 10 is removed from the base piece. The fixing of the base 6 may be strengthened by bonding the closed bottom 7 against the bottom of the base piece 9.

The base piece 9 could be secured to the base 6 using a weighting-down means and a clamping sleeve, as described in FR-A-2,588,167.

A cylindrical casing 11 made of plastic, of small thickness, is fitted tightly onto the tubular element 1. The casing 11 is axially held at the top by a rim 12 of the tubular element 1 which is negotiated, when the casing 11 is engaged over the element 1, by deformation of this element 1 causing a reduction in its diameter. This deformation is allowed, especially, owing to the fact that at least one slideway 2 emerges at the top and cuts through the rim 12.

The casing 11 includes on its internal wall two helical slots 13 offset by 180°, in which the outer ends of the stubs 4 are engaged. The slots 13 emerge at the bottom 11*a* of the casing 11 to allow, especially, engagement of the stubs 4. An outer sleeve 14, generally made of metal, surrounds the casing 11 and is integral therewith. The outer sleeve 14 extends downwards in the longitudinal direction at least as far as close to the level 11*a* where the slots 13 emerge, that is to say a level lower than that of the stubs 4 when the cup 3 is in the lowest possible position, illustrated in FIG. 1.

Flexible bearing means F are provided between the casing 11 and the base 6 of the tubular element 1.

Figure 2:
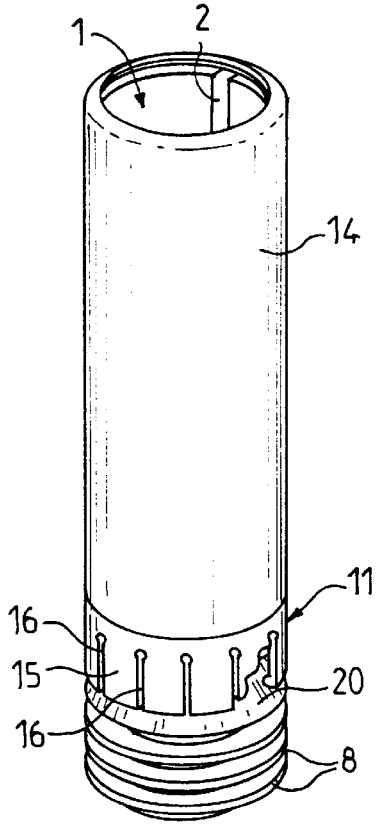
FIG. 2 is a view in perspective with parts cut away of the tubular element surrounded by the cylindrical casing, itself surrounded by the outer sleeve, before they are fitted into the base piece of the device of FIG. 1.
Figure 1A:
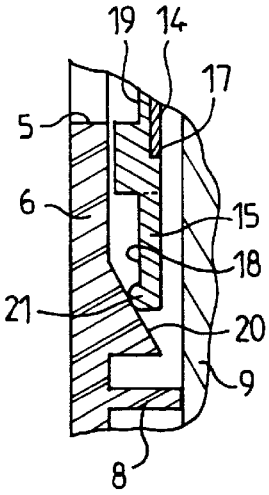

In the example of FIG. 1, these flexible bearing means F comprise flexible tongues 15 provided at the bottom of the casing 11, these tongues, of rectangular shape, being bounded by parallel longitudinal slits 16 (FIG. 2). If need be, just one tongue 15 could be provided, but for preference, several evenly distributed tongues 15 are provided. The tongues 15 are situated, in the longitudinal direction, beyond the lower end of the outer metal sleeve 14, as visible in FIGS. 1 and 2. The tongues 15 are radially offset outwards relative to the casing 11 so that an annular shoulder 17 is formed at the root of the tongues 15, over the outer surface of the casing 11. The outer sleeve 14 comes into axial abutment against this shoulder 17. The outer surface of the tongues 15 is substantially in the extension of the outer surface of the sleeve 14.

The height of the tongues 15 (that is to say their dimension in a direction parallel to the axis of the casing 11) advantageously lies between 2 mm and 20 mm.

The internal surface 18 of the tongues 15 in the state of rest is advantageously situated on the same cylindrical surface as the bottom 19 of the slots 13.

The bearing means F comprise, on the base 6 side, a convex frustoconical surface 20 pointing outwards, the large base of which is situated towards the bottom. This frustoconical surface is at a lower level than that of the lower end of the sleeve 14. The lower end of the tongues 15 bears elastically, on the outside, on the surface 20, substantially halfway up it. The internal surface of the outer base piece 9 is separated from the outer surface of the sleeve 14 by a distance j sufficient to allow the free elastic deformation of the tongues 15 outwards.

The dimensions of the various components are designed so that, on fitting, the tongues 15 exert a radial pressure on the surface 20, while the upper end of the casing 11 is bearing against the rim 12. The elastic clamping action of the tongues 15, combined with the bearing surface 20 which is inclined to the axis of the element 1, ensures self-centering of the casing 11 relative to the tubular element 1 and takes up the longitudinal play with the upper end of the casing 11 coming into abutment against the rim 12. This results in the components being prevented from vibrating against each other, and in protection of the stick B of cosmetic product against shocks and shaking.

The clamping action may correspond to a variation of 0.02 mm to 1.5 mm in the diameter of the circular contour enveloping the tongues 15 at rest, at their free ends.

The tongues 15 advantageously include an internal peripheral bead 21 at their lower end, this bead having a rounded transverse section to facilitate sliding against the surface 20.

The presence of the tongues 15 which project downwards beyond the open end of the slots 13 facilitates the demolding of the casing 11. Indeed, to demold the slots 13 it is necessary to give a molding core (not shown), which includes ribs conjugate to the slots 13, a helical movement. The presence of the tongues 15 makes it possible to hold the casing 11 in terms of rotation relative to the molding core and to achieve the helical movement, between core and casing, intended to release the core from the slots 13.

It should be noted that the action of the elastic tongues 15 on the inclined bearing surface 20 is situated at a lower level than the stubs 4, so that the risks of the cup 3 jamming owing to deformation of the base 6 due to clamping exerted by the tongues 15 is practically eliminated.

In certain cases, the tongues 15 instead of being secured to the casing 11 may be provided on a ring whose upper longitudinal edge would replace, for example, the shoulder 17 in FIG. 1. This ring would be free to rotate relative to the casing 11, while being held axially between the lower end of the casing 11 (which would be situated at the level of the shoulder 17 of FIG. 1) and the frustoconical surface 20. This ring would be attached to the tubular element 1.

The operation of the device D of FIGS. 1 and 2 stems immediately from the foregoing explanations.

In order to apply lipstick with the aid of the stick B, it is appropriate first of all to remove the cap 10. The user can then hold the metal sleeve 14 and turn the base piece 9 relative to this sleeve, entraining the tubular element 1 in rotation. The sleeve 11 remains immobile with the casing 14, and the cup 3 rises up inside the tubular element owing to its stubs 4 running in the helical slots 13.

During this rotational movement between the tubular element 1 and the casing 11, the tongues 15 constantly bear elastically against the frustoconical surface 20, which takes up play and ensures permanent self-centering and gives a smooth nature to the rotational movement, with a braking effect.

Figure 3:
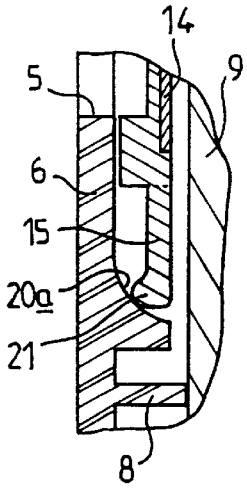
FIG. 3 is a detail in section, on a larger scale, illustrating a variant embodiment of the flexible bearing means.

FIG. 3 illustrates a variant embodiment in which the bearing surface 20*a,* inclined to the axis, instead of being frustoconical is formed by a surface of revolution whose meridian is an outwardly concave arc of a curve, for example an arc of a circle. The interaction of the tongues 15 with this bearing surface 20*a* also provides self-centering and an anti-vibration effect, as in the case of FIGS. 1 and 2.

Figure 4:
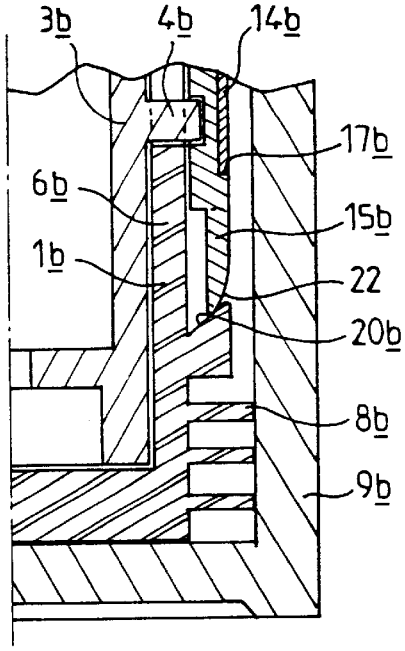
FIG. 4 is a partial axial section, on a larger scale, illustrating another variant embodiment of the flexible bearing means.
Figure 5:
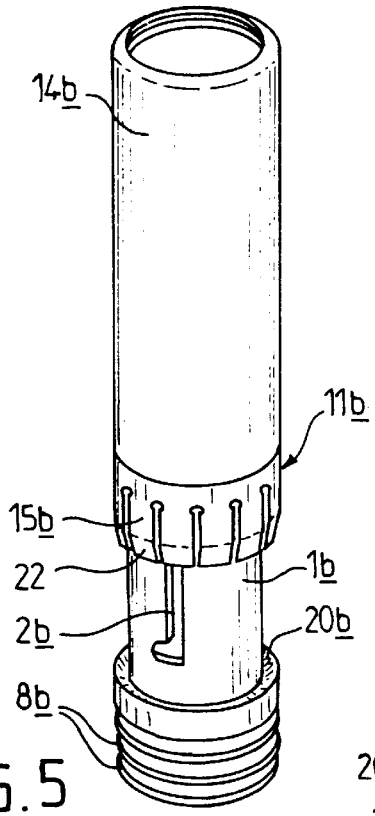
FIG. 5 is a view in perspective, on a smaller scale, of the tubular element of FIG. 4, and of the cylindrical casing equipped with the outer sleeve, in the course of being fitted.

Referring to FIGS. 4 and 5, a variant embodiment can be seen in which the frustoconical surface 20*b* is still provided on the base 6 of the tubular element at the bottom. However, the surface 20*b* is concave, pointing inwards, and its large-diameter end is situated at the top while its small base is situated at a lower level.

Similar elements or elements playing similar parts to elements in FIGS. 1 and 2 are denoted by the same numerical references followed by the letter b, without their description being repeated.

The small base of the surface 20*b* is situated at the lower part of this surface, at its junction with the cylindrical surface of the tubular element 1*b.* The frustoconical surface 20*b* flares from the bottom upward and defines, together with the adjoining external cylindrical wall of the tubular element 1*b,* an annular space with a transverse section in the form of a dihedron, the apex of which points downwards.

The tongues 15*b* are provided at the bottom of the tubular casing 11*b* under conditions similar to those described with regard to FIGS. 1 and 2. The lower end of the tongues 15*b* comes to bear against the surface 20*b* and the tongues 15*b* are deformed elastically inwards, in the radial direction. The action of the tongues 15*b* on the inclined bearing surface 20*b* provides self-centering and an anti-vibration effect similar to the one described with regard to FIGS. 1 and 2.

For preference, the tongues 15*b* have a variable thickness which diminishes at the bottom so that the lower end 22 of the tongues 15*b* is thinned and has an outer face which is inclined relative to the axis of the casing 11*b* to slide better on the surface 20*b.*

Figure 6:
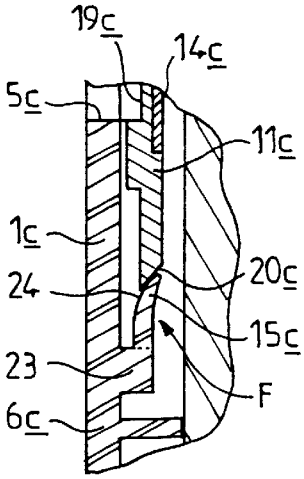
FIG. 6 is a partial axial section illustrating another variant embodiment of the flexible bearing means.
Figure 7:
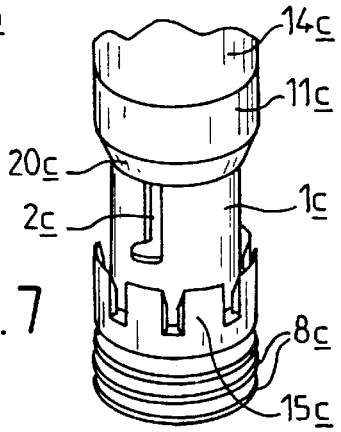
FIG. 7 is a partial view in perspective of the cylindrical casing equipped with the outer sleeve in the course of fitting to the tubular element of FIG. 6.

FIGS. 6 and 7 illustrate another embodiment possibility which, in some ways, consists of the reverse of the embodiment of FIGS. 4 and 5 in that the tongues 15*c,* in the case of FIGS. 6 and 7, are secured to the tubular element 1*c* and point from the bottom upwards, while the frustoconical surface 20*c* is provided at the bottom of the sleeve 11*c.* The elements which are similar to elements already described with regard to the preceding figures carry the same numerical references followed by the letter c, without their description being repeated.

As in the preceding embodiments, the flexible bearing means F formed by the frustoconical surface 20*c* and the tongues 15*c* are situated, in the axial direction, beyond the lower end of the metal outer sleeve 14*c.* The large base of the frustoconical surface 20*c* has substantially the same diameter as the outer cylindrical surface of the sleeve 14*c,* while the internal cylindrical surface of the casing 11*c,* at the level of the frustoconical surface 20*c,* has a diameter equal to that of the bottom 19*c* of the helical slots. The frustoconical surface 20*c* diminishes in diameter from top to bottom.

The tongues 15*c* are distant from the outer cylindrical surface of the tubular element 1*c* and are secured at their roots to an annular bead 23 forming an integral-part of this tubular element 1*c.* The upper part 24 of the internal face of the tongues 15*c* is preferably inclined relative to the axis of the tubular element 1*c,* so that the radial thickness of the tongues 15*c* diminishes progressively from the bottom up. This inclined face 24 interacts with the frustoconical surface 20*c* and provides self-centering and the anti-vibration effect described with regard to the preceding figures.

Figure 8:
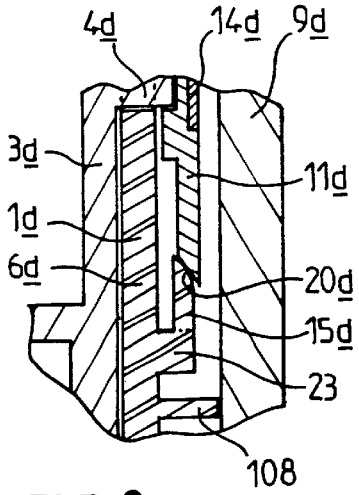
FIG. 8 is a partial section of another variant embodiment.

FIG. 8 illustrates a variant embodiment of FIGS. 6 and 7. The similar elements are denoted by the same numerical references, followed by the letter d. The tongues 15*d,* according to FIG. 8, are provided, as in the case of FIGS. 6 and 7, at the bottom part of the tubular element 1*d;* they project upwards from the annular bead 23. The tongues 15*d* are sufficiently distant from the outer surface of the tubular element 1*d* to be capable of deforming elastically radially inwards.

The frustoconical surface 20*d* provided at the bottom part of the sleeve 11*d* is concave, points inwards and flares from top to bottom. This surface 20*d* is provided on the internal side of the sleeve 11*d.*

The upper end of the tongues 15*d* is tapered and has an external surface which is inclined relative to the axis of the tubular element 1*d.* The upper ends of the tongues 15*d* are situated radially inside the surface 20*d.*

The tongues 15*d,* urged radially inwards, exert an elastic force on the frustoconical surface 20*d* exhibiting a radial component and an axial component as in the preceding examples, which ensure self-centering and an anti-vibration effect.

Figure 9:
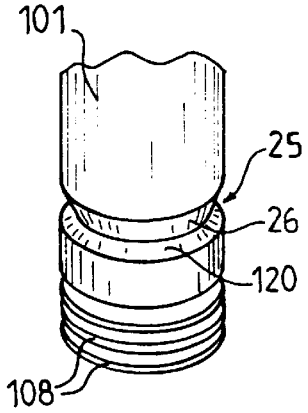
FIG. 9 is a partial view in perspective of a variant embodiment of the tubular element and of the inclined bearing surface.
Figure 10:
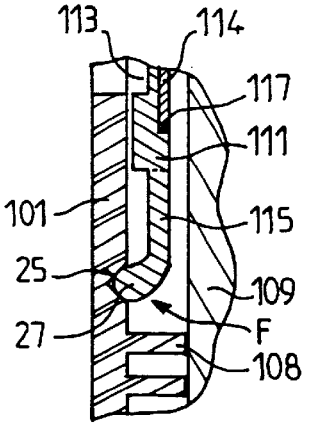
FIG. 10 is a view in partial section of the flexible bearing means of a device equipped with a tubular element as illustrated in FIG. 9.

FIGS. 9 and 10 illustrate a variant embodiment in which the elements similar to elements already described are denoted by numerical references having the same figures in the tens and units preceded by the FIG. 1 in the hundreds. The same will be true of the variants of the following figures, in which the figure in the hundreds alone will be modified.

The frustoconical surface 120, provided at the bottom of the tubular element 101, in a way similar to FIG. 1, constitutes part of an annular groove 25 with a V-shaped transverse section extending around the tubular element 101. The frustoconical surface 120 constitutes the lower part of the groove 25 and decreases in diameter from the bottom up in order to join the bottom of the groove 25. Another frustoconical surface 26, increasing in diameter from the bottom up, constitutes the upper part of the groove 25.

As visible in FIG. 10, the end of the tongues 115 provided at the bottom of the casing 111, is equipped with a rounded nose 27 projecting radially inwards, designed to interact with the two surfaces 120 and 26.

The flexible bearing means F of FIGS. 9 and 10, consisting of the tongues 115 and of the groove 25 with its surfaces 120, 26, provide not only the self-centering and anti-vibration effect described with regard to the preceding figures, but also hold the casing 111 relative to the tubular element 101 in the longitudinal direction.

It is obvious that the meridian section (that is to say the section through a plane passing through the axis of the tubular element 101) of the groove 25 could be bounded not by straight segments as represented, but by concave or convex arcs of a curve.

Figure 11:
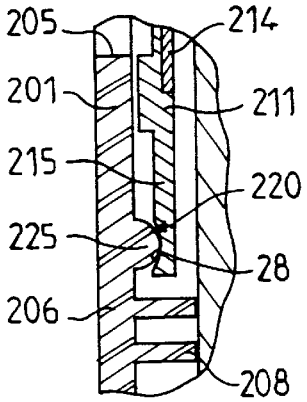
FIG. 11 is a partial section of a variant embodiment of the cylindrical casing and of the tongues.
Figure 12:
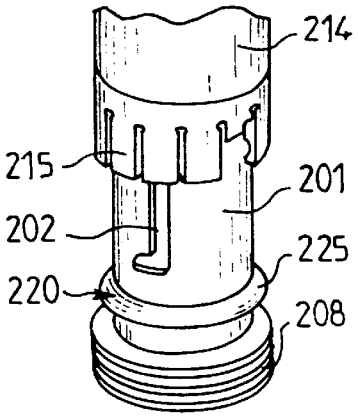
FIG. 12 is a partial view in perspective of the cylindrical casing of FIG. 11 and of the corresponding tubular element.

FIGS. 11 and 12 illustrate a variant embodiment of FIGS. 9 and 10, according to which variant the groove 25 is replaced by a peripheral rib 225 with a meridian section in the shape of a convex arc of a curve, running around the outer bottom part of the tubular element 201.

The tongues 215 provided at the bottom of the cylindrical casing 211 are equipped on their internal surface with a recess 28 having a transverse section conjugate to the peripheral rib 225 so as to ensure the self-centering and longitudinal holding of the casing 211 relative to the tubular element 201.

Figure 13:
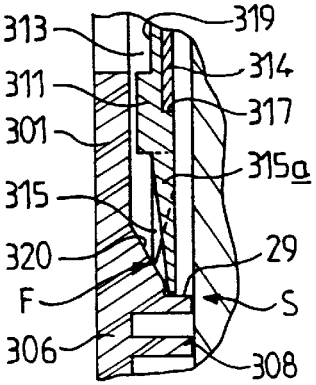
FIG. 13 is a view in partial section illustrating means for axial abutment between the tubular element and the cylindrical casing.

FIG. 13 illustrates a variant embodiment according to which the base of the tubular element 301 includes axial abutment means S designed to interact with the lower end of tongues 315*a* provided at the bottom of the cylindrical casing 311, so as to limit the axial engagement of the tubular element 301 into the said casing 311.

The abutment means S advantageously consist of an annular shoulder 29, situated radially on the outside of the frustoconical surface 320. The shoulder 29 is situated in a plane orthogonal to the axis of the tubular element 301.

Figure 14:
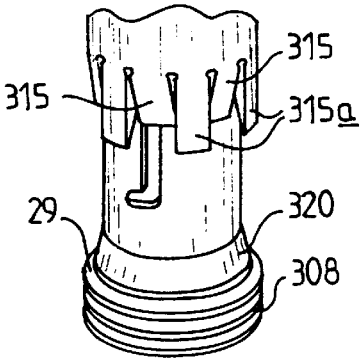
FIG. 14 is a view in perspective of the cylindrical casing of FIG. 13 and of the tubular element.

Two groups of alternating tongues 315, 315*a* are provided at the bottom of the casing 311 as illustrated in FIG. 14. The tongues 315 of the first group, belonging to the flexible bearing means F, are intended to bear via their lower ends against the frustoconical surface 320 to provide self-centering and braking. The internal face of the tongues 315 is substantially parallel to the axis of the cylindrical casing and in the extension of the surface on which the bottoms 319 of the slots are situated. The external face of the tongues 315 is inclined relative to the axis of the casing 311 and progressively nears this axis from top to bottom.

The tongues 315*a* of the second group have a different profile from that of the tongues 315, and a greater height than that of these same tongues 315. The external face of the tongues 315*a* is substantially parallel to the axis of the casing 311, while the internal face is inclined relative to this axis so as to move away therefrom progressively from top to bottom. In this way, the tongues 315*a* cannot interact with the surface 320, and act solely to limit the extent to which the casing 311 is driven onto the tubular element 301, by coming into abutment via their lower end against the shoulder 29.

Figure 15:
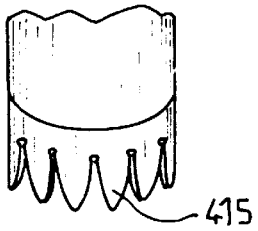
FIG. 15 is a partial view in perspective of the bottom part of the cylindrical casing equipped with tongues of non-rectangular shape.

As illustrated in FIG. 15, the tongues 415 may have various shapes, particularly edges which are not parallel or straight. These various shapes, particularly curved ones, are also possible for the lengthwise profiles of the tongues.

FIG. 16 illustrates a means of fastening between the base 506 of the tubular element 501 and the outer base piece 509.

This fastening means comprises at least one elastic protuberance 30 forming a fastening catch, capable of projecting radially from the external lateral surface of the base 506 of the tubular element 501. In general, several protuberances 30 are distributed evenly over the periphery of the base.

The base piece 509, intended to receive the lower part of the tubular element 501, includes a conjugate means consisting of a recess 31 provided on the internal face of the element 501. The upper edge 31*a* of the recess 31 is situated in a plane orthogonal to the axis of the base piece 509 so as to constitute a stop surface for the upper edge 30*a* of the protuberance 30, also situated in a plane orthogonal to the axis of the element 501. The recess 31 is produced during molding of the base piece 509 and an opening 32 remains in the bottom of the base piece 509, which corresponds to the passage necessary for removing, after molding, a slide which made it possible to produce the recess 31.

The tubular element 501 is automatically fastened into the base piece 509 at the end of driving in the tubular element 501. The elastic protuberances 30 which, during the driving-in, are pushed aside radially inwards by the internal wall of the base piece 509 return to the position illustrated in FIG. 16 when they arrive at the level of the recess 31. The nose of the protuberance 30 then projects under the transverse upper edge 31*a* of the recess 31, which fastens the tubular element 501 into the base piece 509.

Figure 18:
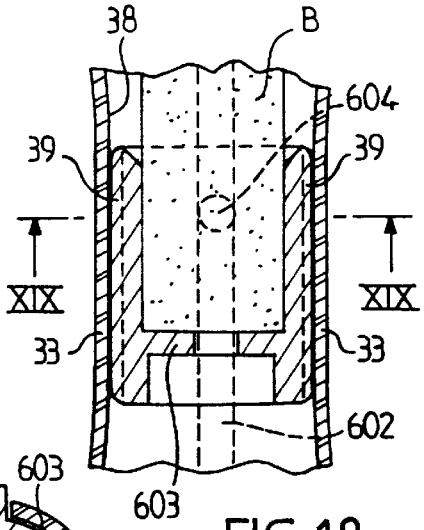
FIG. 18 is a view in vertical section, on a larger scale, of the tubular element of FIG. 17 and of the cup mounted in this element.
Figure 17:
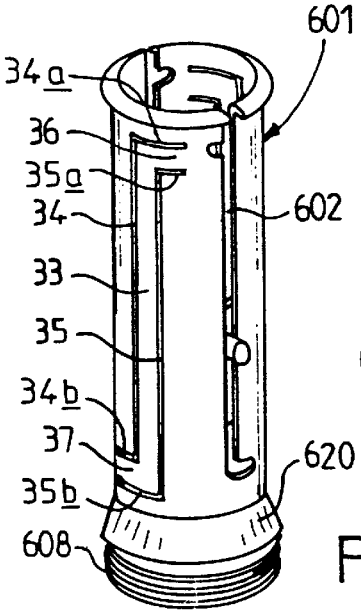
FIG. 17 is a view in perspective of the tubular element including an elastic strip, bounded by two longitudinal slits, designed to interact with a protuberance of the cup.

FIGS. 17 to 19 illustrate a characteristic of the invention which can be used independently or in combination with the characteristics set out previously.

The tubular element 601 with a slideway 602 of the device for applying a cosmetic product such as lipstick, includes at least one relatively elastic strip 33 bounded by two longitudinal slits 34, 35 substantially parallel to the axis of the tubular element. The strip 33 is attached at its narrow ends 36, 37 to the tubular element 601. For preference, two diametrically opposed strips 33 are provided in the tubular element 601, offset by 90° relative to the two slideways 602.

Advantageously, the longitudinal slits 34, 35 include, at the top and the bottom, a peripheral segment with a right angle, forming returns 34*a*, 34*b* or 35*a*, 35*b*. The end returns of one and the same slit point in opposite directions.

The internal longitudinal profile 38 (see FIG. 18) of the strip 33 is preferably convex inwards so that it can exert radial clamping on the cup 603.

This cup 603 includes at least one outer protuberance 39 projecting radially and designed to bear against the internal surface of a strip 33. In the example in question, two diametrically opposed protuberances 39, offset by 90° relative to the stubs 604, are provided on the outer surface of the cup 603. Advantageously, the protuberances 39 consist of ribs extending in the direction of a generatrix of the cup 603 over its entire height (see FIGS. 18 and 19). The cup 603 is thus subjected to an elastic force in the radial direction, which allows the transverse play to be taken up and contact to be maintained between the cup 603 and the internal surface of the tubular element 601, with the elimination of vibration.

The strip 33 bears elastically in a very even way on the cup, regardless of its position in the tubular element 601.

As a variant, as represented in FIG. 19*a*, the protuberance 39*a* may be provided on the internal face of the strip 33 and be in the form of a longitudinal bead over the entire length of the strip 33, particularly halfway across its width.

At the bottom of the tubular element 601 there is, again, a frustoconical surface 620 belonging to the flexible bearing means which may include, on the cylindrical casing side (not represented), tongues spreading out towards the bottom in a frustoconical shape substantially complementary to that of the surface 620.

Referring to FIG. 20, there can be seen a variant embodiment for fixing the base 706 of the tubular element 701. This base 706 includes a central hole 40 in a thick bottom wall, or a shaft, capable of fitting tightly with clamping over a pip 41, particularly of frustoconical shape, provided as a projection at the center of the bottom of the base piece 709. The presence of the discs 8 in FIG. 1 is no longer necessary. The pip 41 has an axial passage passing through it.

As a variant, as illustrated in FIGS. 21 and 22, the base 806 includes a central hole 840 and radial slits 42 in a star radiating from the hole 840. The slits 42 define elastically deformable sectors 43.

The base piece 809 includes a frustoconical central pip 841 equipped with catches 44 projecting from its surface, onto which the internal ends 45 of the sectors 43 of the bottom of the base 806 become fastened.

In the variant of FIGS. 23 and 24, the starlike radial slits 942 extend over the lower zone 46 of the cylindrical wall of the base 906 in the form of straight parts 47. This lower zone 46 will have a certain elasticity in the radial direction and will deform, increasing in diameter as illustrated in FIG. 24 when the stub 941 is being engaged in the hole 940. A ring of tabs 48 projecting from the bottom of the base piece 909 is advantageously provided in order to snap-fasten the deformed lower edge of the base 906 and supplement the fixing provided by the pip 941.

It should be noted that the base piece 9-909 of the examples in question may be a decorative covering base piece, or a weighting-down means which is, itself, surrounded by a decorative covering.

FIG. 25 shows an embodiment variant of FIG. 1 making it possible to remove a tubular element 1 whose stick B is used up, to replace it with a new refill. Parts which are identical or fulfill similar roles to those already described with regard to FIG. 1 are denoted by the same references, possibly followed by an apostrophe " ' ", without their description being repeated.

The base piece 9' consists of a metal sleeve acting as decoration. The inside diameter of the base piece 9' over most of the height, is markedly greater than the outside diameter of the sleeve 14. The base piece 9' at its upper end has a neck 49 of smaller outside diameter and the inside diameter of which is equal, to within the operating clearance, to the outside diameter of the sleeve 14. The superimposed discs 8 have sufficient diameter to bear against the internal surface of the large-diameter part of the base piece 9', so that the discs 8 cannot pass through the neck 49.

The base piece 9' includes a removable bottom 50, consisting of a disc equipped, at its periphery with snap fastening means 51 capable of interacting with conjugate means 52, for example a circular rib, which are provided on the internal wall of the base piece 9'.

When the stick of lipstick of the element 1 is used up, the user can remove the bottom 50, of the base piece 9', and take out the used up element by sliding downwards. A refill is then fitted, by sliding upwards; the bottom 50 is then fixed, by snap fastening, into the base piece 9'.

FIG. 26 illustrates a variant embodiment of the device of FIG. 16, this variant making it possible to refill the device with an element equipped with a new stick of lipstick.

The base piece 509' includes a bottom 53, which is separate, consisting of a disc of which the circular peripheral edge is equipped with a cylindrical skirt 54 engaged quite tightly in the base piece 509'. The bottom 53 is held in the base piece 509' by an internal bead 55, of this base piece, received in an annular groove 56 provided at the lower peripheral part of the bottom 53.

The bottom 53 includes at least one spring tab 57, formed at the time of molding with the bottom, and bearing against the lower part of the tubular element 501, possibly by means of a plate 58. Preferably, several evenly distributed spring tabs 57 are provided in the bottom 53. Each tab 57 works in bending and tends to rise elastically pushing back the plate 58 and the element 501.

The internal upper edge of the skirt 54 is arranged in the form of a frustoconical surface 59 of which the large base points upwards. The surface 59 is designed to slide against the external frustoconical surface of the protuberances 30 when the bottom 53 is in place, held in axially by the bead 55. The bottom 53 is immobilized in terms of rotation relative to the base piece 509', for example by a series of conjugate ribs and splines, parallel to the axis of the base piece and provided respectively on the external cylindrical surface of the skirt 54 and the adjacent internal cylindrical surface of the base piece 509'. The frustoconical surface 59, rubbing against the protuberances, exerts rotational braking between the element 501 and the bottom 53 connected in terms of rotation to the base piece 509'.

The bottom 53 can slide slightly, towards the inside of the base piece 509', under the effect of a thrust from the user, counter to the force exerted by the tab(s) 57. This sliding causes radial inwards bending of the protuberances 30, following interaction of the frustoconical surfaces. The stop surface 30*a* of each protuberance is thus freed from the upper edge 31*a*. The element 501, whose stick of lipstick is used up, can then be removed upwards, and be replaced by a full refill inserted from top to bottom until the protuberances 30 fasten under the edge 31*a*.

Regardless of the embodiment, the substance used for the cylindrical casing such as 11, including the helical slot or slots, is chosen from among the group of polystyrenes, polyolefins, polyacetals, derivatives of polytetrafluoroethylene and polyesters.

The molded substance of the base piece 9, 109 is preferably chosen from among the group of polyolefins, polystyrenes, cellulose acetates and propionates, vinyl polymers, polyacetals, and derivatives of polytetrafluoroethylene.

The substance used for molding the base piece and tubular element on the one hand and/or the cylindrical casing 11 on the other hand preferably includes from 0.2 to 20% of a sliding agent such as boron nitride, molybdenum disulphide, graphite or silicones.

What is claimed is:

1. Device for applying a pasty product, presented in the form of a stick, comprising:

a tubular element with a slideway in which is mounted so that it can slide a cup intended to receive the stick of product and including at least one stub engaged in a slideway;

a cylindrical casing in the wall of which there is provided at least one helical slot, this casing being fitted tightly onto the tubular element and being held on the latter by an axial abutment, the stub of the cup being engaged in a slot of the casing;

and an outer sleeve in which the casing is immobilized, while the tubular element can turn relative to the said casing and sleeve, plural flexible tongues axially oriented in the same direction, and provided between the two components consisting of the casing and the tubular element, said tongues being flexible in the radial direction, provided on one of the two components and designed to interact with a bearing surface which is inclined radially of the axis of the tubular element, provided on the other component, said plural flexible tongues (15–15*d:* 115–315) and the inclined bearing surface (20–20*d;* 120–320) being situated, in the axial direction, beyond the lower end of the outer sleeve (14–14*d;* 114–314), thereby to provide sufficient radial space to accommodate the flexible tongues.

2. Device according to claim 1, characterized in that the bearing surface (20) is frustoconical.

3. Device according to claim 1, characterized in that the bearing surface (20*a*) is formed of a surface which is outwardly concave.

4. Device according to claim 1, characterized in that at least two diametrically opposed elastic tongues (15–15*d;* 115–315) are designed to interact with the inclined bearing surface (20–20*d;* 120–320).

5. Device according to claim 1, characterized in that the inclined bearing surface is a frustoconical surface (20, 20*a,* 20*b,* 220, 225, 320) provided on the base (6, 6*b,* 206, 306) of the tubular element, while said plural tongues (15, 15*b,* 215, 315) are provided on the cylinder casing.

6. Device according to claim 5, characterized in that the frustoconical surface (20, 120, 320) points such that its large diameter is situated at the bottom, said plural tongues (15, 115, 315) being provided at the bottom of the casing (11, 111, 311) and being radially offset outwards relative to the casing so that an annular shoulder (17, 117, 317) is formed at the root of the tongues, on the outer surface of the casing, this shoulder constituting an axial abutment for the outer sleeve (14, 114, 314).

7. Device according to claim 5, characterized in that the frustoconical surface (20*b*) provided on the base (6*b*) points so as to have its large diameter at the top, this surface (20*b*) being concave, while said plural tongues (15*b*) provided at the bottom of the casing (11*b*) are urged inwards by the said frustoconical surface (20*b*).

8. Device according to claim 5, characterized in that an internal face (18) of the tongues (15, 15*b,* 115, 315) provided at the bottom of the cylindrical casing is situated substantially on the same cylindrical surface as the bottom (19, 119, 319) of the helical slot (13, 113, 313).

9. Device according to claim 1, characterized in that the inclined bearing surface is a frustoconical surface (20*c,* 20*d*) provided at the bottom of the casing (11*c,* 11*d*) equipped with the helical slot, while the tongues (15*c,* 15*d*) are provided on the base (6*c,* 6*d*) of the tubular element and point upwards so as to interact outwards or inwards with the abovementioned frustoconical surface (20*c,* 20*d*).

10. Device according to claim 1, characterized in that the inclined bearing surface (120, 220) constitutes part of a groove (25) or of a rib (225) with a transverse section in the form of a V or of an arc of a curve, with which a part (27, 28) of conjugate shape of the or of each tongue (115, 215) interacts.

11. Device according to claim 1, characterized in that the tongues (15*b,* 15*c,* 15*d,* 315) have a radial thickness which varies in the axial direction, this thickness diminishing in the direction of the free end of the tongue.

12. Device according to claim 1, characterized in that the tongues (415) have a curved shape, both as regards their contour and their profile length-ways in a plane passing through the axis of the device.

13. Device according to claim 1, characterized in that the tongues include, at their ends, means making it possible to improve sliding and to diminish friction.

14. Device according to one of claims 1 to 5, characterized in that the tubular element (1) with a slideway includes a closed bottom (7) designed to reinforce its rigidity and facilitate its fastenings to a base piece (9).

15. Device according to claim 1, characterized in that the tubular element includes a base having, underneath-the flexible tongues means, radially projecting annular discs (8-608) designed to fasten the tubular element into a base piece (9).

16. Device according to claim 1, characterized in that a base (506) of the tubular element (501) includes at least one elastic protuberance (30) designed to project radially on its external lateral surface and capable of being deformed elastically inwards, while a base piece (509) intended to cover over the lower part of the tubular element includes conjugate fastening means, comprising a recess (31) provided on the internal surface of the base piece and into which the corresponding elastic protuberance (30) can snap-fasten.

17. Device according to claim 16, characterized in that the bottom (53) of the base piece (509') is mounted so that it can slide in this base piece, but connected in terms of rotation to the said base piece, elastic means (57) being provided between the bottom (53) and the lower part of the tubular element (501), the bottom (53) being equipped with a cylindrical skirt of which the internal upper edge has a frustoconical shape (59) conjugate to the frustoconical surface of the (some) protuberance(s) (30), the whole being such that in the normal position, the upper edge (59) of the bottom exerts a braking action on the protuberance (30) and the tubular element (501), whilst by driving the bottom (53) in axially the protuberance(s) (30) is (are) made to bend radially inwards with unfastening of the tubular element (501) which can be removed from above and replaced by a refill.

18. Device according to claim 1, characterized in that a base (706) of the tubular element (701) includes a central hole (40) designed to fit tightly, with clamping, over a pip (41) projecting from the bottom of the base piece (709).

19. Device according to claim 1, characterized in that a base (806, 906) includes a central hole (840, 940) and star-like radial slits (42, 942) radiating from this hole, and defining deformable sectors (43, 943), while a base piece (809, 909) includes a pip (841, 941) onto which the internal ends (45, 945) of the sectors (43, 943) of the bottom of said base (806, 906) fasten.

20. Device according to claim 1, characterized in that a base (306) of the tubular element includes axial abutment means (29) on its outer surface, situated radially outwards relative to the rubbing means (F), these axial abutment means (29) being designed to interact with the lower end of tongues (315*a*) provided at the bottom of the cylindrical casing (311) so as to limit the axial engagement of the tubular element (301) into the said cylindrical casing.

21. Device according to claim 20, characterized in that the tongues (315, 315*a*) consist of two groups having different heights and profiles, the tongues (315) of one group belonging to the bearing means and being intended to bear, via their ends, on the said inclined bearing surface (320), while the tongues (315*a*) of the second group are situated radially outside the bearing surface (320) so that they can interact solely with the axial abutment means (29) of the base, the tongues (315*a*) of this second group having a greater height than that of the first group (315).

22. Device according to claim 21, characterized in that the internal face of the tongues of the second group (315*a*) progressively moves away from the axis of the cylindrical casing (311) from top to bottom, while the external face is substantially parallel to this axis, while the tongues (315) of the first group have a different shape with their internal face substantially parallel to the axis and their external face progressively nearing the axis from top to bottom.

23. Device according to claim 1, characterized in that the maximum outer diameter of said tongues (F) is substantially equal to the outer diameter of the said sleeve (14–14*d*, 114–314).

24. Device according to claim 1, characterized in that the substance used for the cylindrical casting (11-311) including said at least one helical slot is chosen from among thee group consisting of polystyrenes, polyolefins, polyacetals, derivatives of polytetrafluoroethylene and polyesters.

25. Device according to claim 1, characterized in that the molded substance of the tubular element (1-601) is chosen from among the group of polyolefins, polystyrenes, cellulose acetates and propionates, vinyl polymers, polyacetals, and derivatives of polytetrafluoroethylene.

26. Device according to claim 1, characterized in that the substance used for moulding at least one of the tubular element (1-601) and the cylindrical casing (11-311) equipped with the helical slot, includes from 0.2 to 20% of a sliding agent.

27. Device according to claim 1, characterized in that a base of said tubular element (6) is equipped on its periphery with superimposed discs (8) of sufficient outside diameter to ensure good fastening of the base (6) into an outer base piece (9).

28. Device according to claim 27, characterized in that the bottom (50) of the outer base piece (9') is removable and that the tubular element (1) can be removed downwards, when the bottom (50) is taken off, in order to be replaced by a refill, with the bottom being put back in place.

29. Device according to claim 1, further comprising an outer base piece in which said other component is received, and a removable cap adapted to be seated on said base piece and which, when fully seated on said base piece, presses said outer sleeve in a direction to engage said tongues with said radially inclined bearing surface.

30. Device for applying a pasty product, presented in the form of a stick, comprising:

a tubular element with a slideway in which is mounted so that it can slide a cup intended to receive the stick of product and including at least one stub engaged in a slideway;

a cylindrical casing in the wall of which there is provided at least one helical slot, this casing being fitted tightly onto the tubular element and being held on the latter by an axial abutment, the stub of the cup being engaged in a slot of the casing;

and an outer sleeve in which the casing is immobilized, while the tubular element can turn relative to the said casing and sleeve, plural flexible tongues angularly offset with respect to each other and provided between the two components consisting of the casing and the tubular element, said tongues being flexible in the radial direction, provided on one of the two components and designed to interact with a bearing surface which is inclined radially of the axis of the tubular element, provided on the other component, said plural flexible tongues and the inclined bearing surface being situated, in the axial direction, beyond the lower end of the outer sleeve, thereby to provide sufficient radial space to accommodate the flexible tongues.

31. Device for applying a pasty product, presented in the form of a stick, comprising:

a tubular element with a slideway in which is mounted so that it can slide a cup intended to receive the stick of product and including at least one stub engaged in a slideway;

a cylindrical casing in the wall of which there is provided at least one helical slot, this casing being fitted tightly onto the tubular element and being held on the latter by an axial abutment, the stub of the cup being engaged in a slot of the casing;

and an outer sleeve in which the casing is immobilized, while the tubular element can turn relative to the said casing and sleeve, plural flexible tongues provided between the two components consisting of the casing and the tubular element, each of said tongues extending from a root to a free end, the roots of said tongues having a same axial position, said tongues being flexible in the radial direction, provided on one of the two components and designed to interact with a bearing surface which is inclined radially of the axis of the tubular element, provided on the other component, said plural flexible tongues and the inclined bearing surface being situated, in the axial direction, beyond the lower end of the outer sleeve, thereby to provide sufficient radial space to accommodate the flexible tongues.

32. Device for applying a pasty product, presented in the form of a stick, comprising:

a tubular element with a slideway in which is mounted so that it can slide a cup intended to receive the stick of product and including at least one stub engaged in a slideway;

a cylindrical casing in the wall of which there is provided at least one helical slot, this casing being fitted tightly onto the tubular element and being held on the latter by axial abutment means, the stub of the cup being engaged in a slot of the casing;

and an outer sleeve in which the casing is immobilized, while the tubular element can turn relative to the said casing and sleeve, flexible bearing means being provided between the two components consisting of the casing and the tubular element, these bearing means including plural axially-extending tongues, which are flexible in the radial direction, the plural tongues each having a longest dimension that, in the unbiased state of the tongues, extends axially of the casing and the tubular element, said plural tongues being provided on one of the two components and designed to interact with a bearing surface which is inclined radially of the axis of the tubular element, provided on the other component, said flexible bearing means consisting of said plural tongues and the inclined bearing surface being situated, in the axial direction, beyond the lower end of the outer sleeve, thereby to provide sufficient radial space to accommodate the flexible bearing means.

33. Device for applying a pasty product, presented in the form of a stick, comprising:

a tubular element with a slideway in which is mounted so that it can slide a cup intended to receive the stick of product and including at least one stub engaged in a slideway;

a cylindrical casing in the wall of which there is provided at least one helical slot, this casing being fitted tightly onto the tubular element and being held on the latter by axial abutment means, the stub of the cup being engaged in a slot of the casing;

and an outer sleeve in which the casing is immobilized, while the tubular element can turn relative to the said casing and sleeve, flexible bearing means being provided between the two components consisting of the casing and the tubular element, these bearing means including plural axially-extending tongues, which are flexible in the radial direction, provided on one of the two components, wherein an opening extends completely through said one component to thereby separate said tongues, said tongues being designed to interact with a bearing surface which is inclined radially of the axis of the tubular element, provided on the other component, said flexible bearing means consisting of said plural tongues and the inclined bearing surface being situated, in the axial direction, beyond the lower end of the outer sleeve, thereby to provide sufficient radial space to accommodate the flexible bearing means.

* * * * *